US009761354B2

(12) United States Patent
Sun et al.

(10) Patent No.: US 9,761,354 B2
(45) Date of Patent: Sep. 12, 2017

(54) METHOD OF MANUFACTURING A NANO METAL WIRE

(71) Applicant: INDUSTRIAL TECHNOLOGY RESEARCH INSTITUTE, Hsinchu (TW)

(72) Inventors: Wen-Hsien Sun, Pingzhen (TW); Lien-Tai Chen, Hsinchu (TW); Wen-Chang Chen, Taipei (TW); Jung-Yao Chen, Taichung (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 897 days.

(21) Appl. No.: 14/094,348

(22) Filed: Dec. 2, 2013

(65) Prior Publication Data

US 2014/0315020 A1 Oct. 23, 2014

Related U.S. Application Data

(60) Provisional application No. 61/813,445, filed on Apr. 18, 2013.

(30) Foreign Application Priority Data

Jul. 18, 2013 (TW) ..... 102125685 A

(51) Int. Cl.
*D01D 5/34* (2006.01)
*D01D 10/02* (2006.01)
(Continued)

(52) U.S. Cl.
CPC ..... *H01B 13/148* (2013.01); *D01D 5/003* (2013.01); *D01D 5/0015* (2013.01);
(Continued)

(58) Field of Classification Search
CPC .. D01D 5/0007; D01D 5/0015; D01D 5/0023; D01D 5/003; D01D 5/0038;
(Continued)

(56) References Cited

U.S. PATENT DOCUMENTS 7,105,124 B2 9/2006 Choi
7,112,389 B1 9/2006 Arora et al.
(Continued)

FOREIGN PATENT DOCUMENTS

CN 1545103 A 11/2004
CN 101302682 A 11/2008
(Continued)

OTHER PUBLICATIONS

Chinese Office Action and Search Report, dated Jan. 15, 2016, for Chinese Application No. 201310409298.7.
(Continued)

*Primary Examiner* — Leo B Tentoni
(74) *Attorney, Agent, or Firm* — Birch, Stewart, Kolasch & Birch, LLP

(57) ABSTRACT

Disclosed is a method of manufacturing a nano metal wire, including: putting a metal precursor solution in a core pipe of a needle; putting a polymer solution in a shell pipe of the needle, wherein the shell pipe surrounds the core pipe; applying a voltage to the needle while simultaneously jetting the metal precursor solution and the polymer solution to form a nano line on a collector, wherein the nano line includes a metal precursor wire surrounded by a polymer tube; chemically reducing the metal precursor wire of the nano line to form a nano line of metal wire surrounded by the polymer tube; and washing out the polymer tube by a solvent.

14 Claims, 5 Drawing Sheets

(51) Int. Cl.

| | |
|---|---|
| ***D01D 10/06*** | (2006.01) |
| ***D01F 9/08*** | (2006.01) |
| ***D02G 3/02*** | (2006.01) |
| ***D02J 13/00*** | (2006.01) |
| ***H01B 13/14*** | (2006.01) |
| ***D01D 5/00*** | (2006.01) |

(52) U.S. Cl.
CPC ..... *D01D 5/0023* (2013.01); *D01D 5/0038* (2013.01); *D01D 5/0046* (2013.01); *Y10T 428/294* (2015.01)

(58) Field of Classification Search
CPC ..... D01D 5/0046; D01D 5/0061; D01D 5/34; D01D 10/02; D01D 10/06; D01F 9/08; D02G 3/02; D02J 13/00
USPC ..... 264/10, 172.15, 211.15, 211.16, 211.17, 264/233, 234, 235, 344, 464, 465, 466, 264/484
See application file for complete search history.

(56) References Cited

U.S. PATENT DOCUMENTS

| | | | | |
|---|---|---|---|---|
| 7,144,949 | B2 | 12/2006 | Kaner et al. | |
| 7,158,219 | B2 | 1/2007 | Li et al. | |
| 7,245,370 | B2 | 7/2007 | Bratkovski et al. | |
| 7,287,650 | B2 | 10/2007 | Koslow | |
| 7,438,622 | B2 | 10/2008 | Ra et al. | |
| 7,670,509 | B2 | 3/2010 | Jin et al. | |
| 7,789,930 | B2 | 9/2010 | Ensor et al. | |
| 7,818,065 | B2 | 10/2010 | Llinas et al. | |
| 8,012,326 | B2 | 9/2011 | Weiller et al. | |
| 8,017,586 | B2 | 9/2011 | Gazit et al. | |
| 8,021,524 | B2 | 9/2011 | Suh et al. | |
| 8,056,733 | B2 | 11/2011 | Koslow | |
| 8,058,787 | B2 | 11/2011 | Ra et al. | |
| 8,083,909 | B2 | 12/2011 | Suh et al. | |
| 8,142,501 | B2 | 3/2012 | Macossay-Torres | |
| 8,231,378 | B2 | 7/2012 | Lozano et al. | |
| 8,243,420 | B2 | 8/2012 | Kim et al. | |
| 8,262,980 | B2 | 9/2012 | Chao et al. | |
| 8,281,642 | B2 | 10/2012 | Lee et al. | |
| 8,367,570 | B2 | 2/2013 | Reneker et al. | |
| 2003/0205531 | A1 | 11/2003 | Koslow | |
| 2006/0213829 | A1 | 9/2006 | Rutledge et al. | |
| 2006/0226580 | A1 | 10/2006 | Xia et al. | |
| 2006/0284218 | A1 | 12/2006 | Kaner et al. | |
| 2007/0018361 | A1* | 1/2007 | Xu | D01D 5/0038 264/465 |
| 2008/0305377 | A1 | 12/2008 | Shui et al. | |
| 2009/0059367 | A1 | 3/2009 | O'Malley | |
| 2010/0028674 | A1* | 2/2010 | Ochanda | D01D 5/0038 264/465 X |
| 2010/0106259 | A1 | 4/2010 | Llinas et al. | |
| 2010/0127241 | A1 | 5/2010 | Gruner et al. | |
| 2010/0233812 | A1 | 9/2010 | Sun et al. | |
| 2010/0247908 | A1 | 9/2010 | Velev et al. | |
| 2010/0273258 | A1 | 10/2010 | Lannutti et al. | |
| 2011/0052467 | A1 | 3/2011 | Chase et al. | |
| 2011/0066219 | A1 | 3/2011 | Llinas et al. | |
| 2011/0177332 | A1 | 7/2011 | Park et al. | |
| 2012/0061124 | A1 | 3/2012 | Cui et al. | |
| 2012/0119193 | A1 | 5/2012 | Sekiguchi et al. | |
| 2012/0132644 | A1 | 5/2012 | Gu et al. | |
| 2012/0282484 | A1 | 11/2012 | Joo et al. | |
| 2012/0309250 | A1 | 12/2012 | Velev et al. | |
| 2013/0012598 | A1 | 1/2013 | Velev et al. | |
| 2013/0062796 | A1 | 3/2013 | Coughlin | |
| 2015/0056471 | A1* | 2/2015 | Joo | D01F 9/08 428/687 |

FOREIGN PATENT DOCUMENTS

| | | | |
|---|---|---|---|
| CN | 102530891 | A | 7/2012 |
| CN | 102790166 | B | 10/2014 |
| JP | 60-21966 | A | 2/1985 |
| JP | 64-52822 | A | 2/1989 |
| JP | 3-82821 | A | 4/1991 |
| JP | 2007-197859 | A | 8/2007 |
| JP | 2007-197860 | A | 8/2007 |
| JP | 2009-242880 | A | 10/2009 |
| JP | 2010-121040 | A | 6/2010 |
| JP | 2010-261090 | A | 11/2010 |
| TW | 200302812 | | 8/2003 |
| TW | I265153 | | 11/2006 |
| TW | M366470 | U1 | 10/2009 |
| TW | 200948875 | A1 | 12/2009 |
| TW | 201016921 | A1 | 5/2010 |
| TW | 201028506 | A1 | 8/2010 |
| TW | 201117456 | A1 | 5/2011 |
| TW | I350863 | B1 | 10/2011 |
| TW | M422970 | U1 | 2/2012 |
| TW | 201226644 | A | 7/2012 |
| TW | I370857 | B | 8/2012 |
| TW | I376440 | B1 | 11/2012 |
| WO | WO 2007/001453 | A2 | 1/2007 |
| WO | WO 2013/033367 | A1 | 3/2013 |

OTHER PUBLICATIONS

Nie et al., "Progress on Applications of Inorganic Nanofibers Synthesized by Electrospinning Technique," China Academic Journal Electronic Publishing House, Chemical Journal of Chinese Universities, vol. 34, No. 1, Jan. 2013, pp. 15-29, including English Abstract on p. 29.

Chen et al., "Manipulation on the Morphology and Electrical Properties of Aligned Electrospun Nanofibers of Poly(3-hexylthiophene) for Field-Effect Transistor Applications," Macromolecules, 2011, No. 44, pp. 2883-2892.

Song et al., "Direct electrospinning of Ag/Polyvinylpyrrolidone nanocables," Nanoscale, 2011, No. 3, pp. 4966-4971.

Wang et al., "A convenient route to polyvinyl pyrrolidone/silver nanocomposite by electrospinning," Nanotechnology 17, 2006, pp. 3304-3307.

Wu et al., "Electrospun Metal Nanofiber Webs as High Performance Transparent Electrode," Nano Lett, 2010, pp. 4242-4248.

Zhang et al., "Electrospun Nanofibrous Membranes Surface-Decorated with Silver Nonoparticles as Flexible and Active/Sensitive Substrates for Surface-Enhanced Raman Scattering," Langmuir, 2012, No. 28, pp. 14433-14440.

Taiwanese Office Action and Search Report, dated Dec. 30, 2015, for Taiwanese Application No. 102125685.

* cited by examiner

METHOD OF MANUFACTURING A NANO METAL WIRE

CROSS REFERENCE TO RELATED APPLICATIONS

The present application is based on, and claims priority from Taiwan Application Serial Number 102125685, filed on Jul. 18, 2013, and claims the benefit of U.S. Provisional Application No. 61/813,445, filed on Apr. 18, 2013, the entirety of which are incorporated by reference herein.

TECHNICAL FIELD

The technical field relates to nano metal wire, and in particular, relates to a method for manufacturing the same.

BACKGROUND

Recently, nano technology is widely used in information technology, material technology, biotechnology, and the likes. When the size of a material is scaled down to nano scale, its properties will change according to its shape and size. For example, a silver nanorod or nanowire may have absorption peaks of longitudinal mode and traverse mode under surface plasmon resonance. The nanorod or nanowire with a larger aspect (length-diameter) ratio has a red-shifted absorption peak of longitudinal mode.

A silver nanowire or silver wire with a high aspect ratio has been disclosed by some research teams. However, the conventional silver nanowires have a length of several nanometers (nm) to several micrometers (μm), an aspect ratio of less than 1000 (or even less than 100), and low conductivity.

Accordingly, a novel method for preparing silver nanowires with high conductivity and a high aspect ratio is called-for.

SUMMARY

One embodiment of the disclosure provides a method of manufacturing a nano metal wire, comprising: putting a metal precursor solution in a core pipe of a needle; putting a polymer solution in a shell pipe of the needle, wherein the shell pipe surrounds the core pipe; applying a voltage to the needle while simultaneously jetting the metal precursor solution and the polymer solution to form a nano line on a collector, wherein the nano line includes a metal precursor wire surrounded by a polymer tube; chemically reducing the metal precursor wire of the nano line to form a nano line of a nano metal wire surrounded by the polymer tube; and washing out the polymer tube by a solvent.

One embodiment of the disclosure provides a nano line, comprising: a metal precursor wire; and a polymer tube surrounding the metal precursor wire, wherein the metal precursor wire comprises a metal compound and a chemically reducing agent.

One embodiment of the disclosure provides a nano metal wire, having an aspect ratio of greater than 1000, and a conductivity of between $10^4$ S/m to $10^7$ S/m.

A detailed description is given in the following embodiments with reference to the accompanying drawings.

BRIEF DESCRIPTION OF THE DRAWINGS

The disclosure can be more fully understood by reading the subsequent detailed description and examples with references made to the accompanying drawings, wherein.

DETAILED DESCRIPTION

Figure 1:
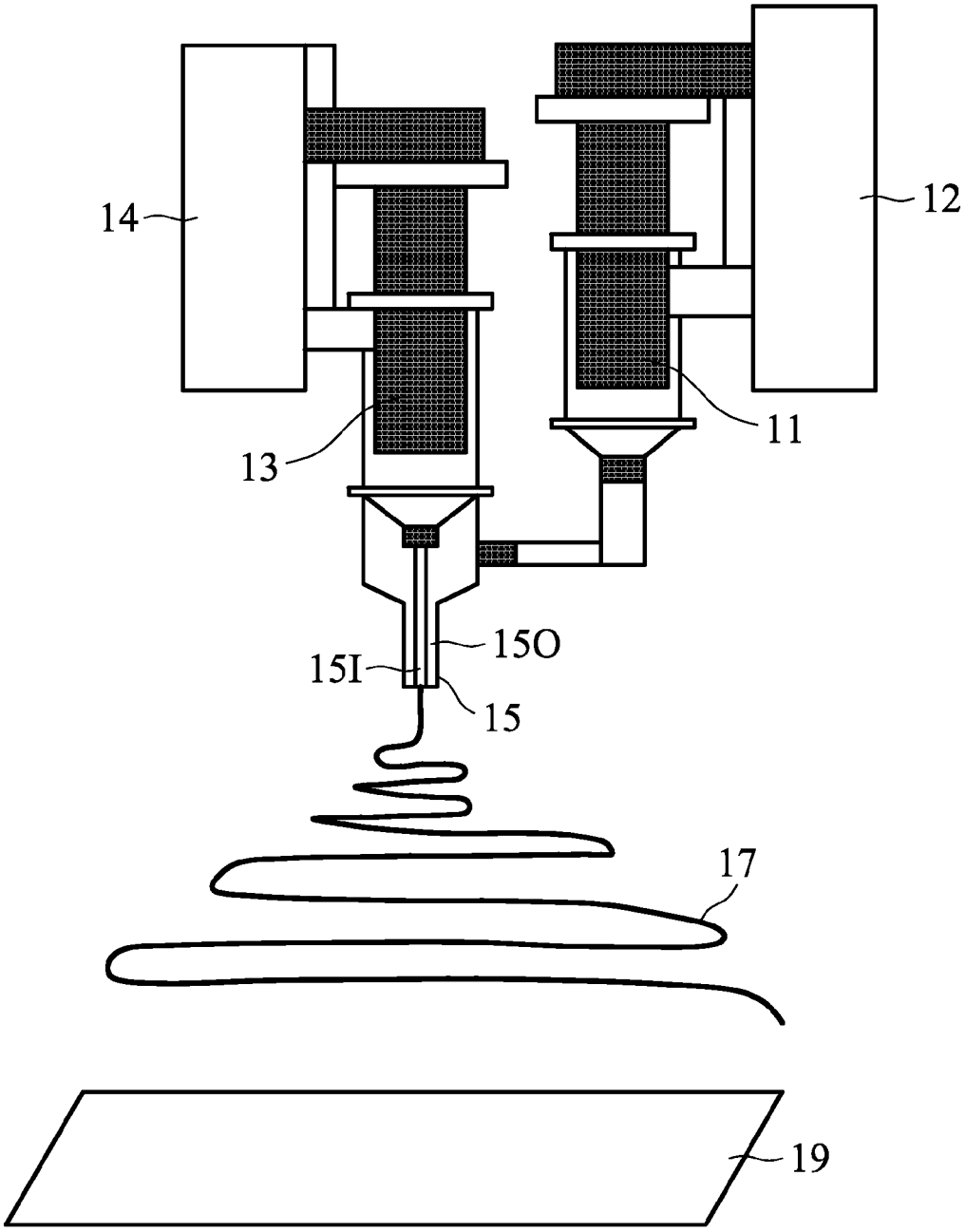
FIG. 1 shows an electrostatic spinning apparatus for manufacturing nano metal wires in one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
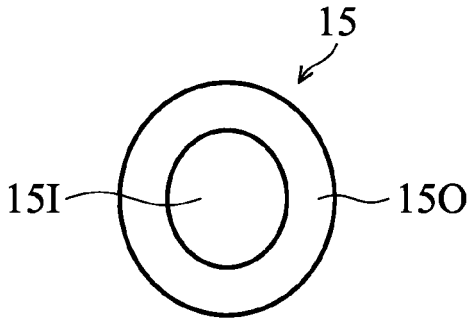
FIG. 2 illustrates a cross-sectional view of a shell pipe and a core pipe of a needle in one embodiment of the disclosure.
Figure 3:
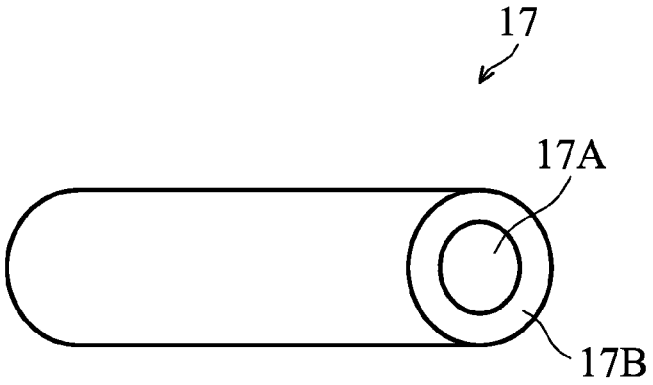
FIG. 3 shows a nano line in one embodiment of the disclosure.

In the disclosure, a nano metal wire having a high aspect ratio (e.g. greater than 1000) is formed by an electrostatic spinning apparatus. As shown in FIG. 1, a polymer solution is put into a syringe 11, and a metal precursor solution is put into a syringe 13. The syringe 11 connects to a shell pipe 15O of a needle 15, and the syringe 13 connects to a core pipe 15I of the needle 15, respectively. As shown in FIG. 2, the shell pipe 15O and the core pipe 15I are concentric cylinders. A voltage is then applied to the needle 15 while simultaneously jetting the metal precursor solution and the polymer solution from the needle 15, thereby forming a nano line 17 on a collector 19. As shown in FIG. 3, the nano line 17 includes a metal precursor wire 17A surrounded by a polymer tube 17B. The described process of forming the nano line 17 is the so-called electrostatic spinning method.

In one embodiment, a solvent of the polymer solution is an organic solvent with high-polarity such as methanol or acetone, and the corresponding polymer is polyvinylpyrrolidone (PVP). In addition, a salt such as tetrabutyl ammonium phosphate (TBAP) or cetyltrimethylammonium bromide (CTAB) can be optionally added into the polymer solution. The salt may enhance the polarization degree of the electrostatic spinning, thereby reducing the polymer amount.

In one embodiment, the additive amount of the salt is of about 1 mg/mL to 100 mg/mL. Alternatively, a solvent of the polymer solution can be an organic solvent with low-polarity such as tetrahydrofuran (THF), toluene, or chloroform. In this case, the corresponding polymer can be polyacrylonitrile (PAN), polyvinyl alcohol (PVA), or ethylene vinyl alcohol (EVA). If the solvent of the polymer solution is an organic solvent with high-polarity, it can be washed out by water to meet environmentally friendly requirements after the forming of a nano metal wire. If the solvent of the polymer solution is an organic solvent with low-polarity, the polymer solution and the metal precursor solution will be immiscible when forming the nano metal wire having a high quality. In one embodiment, the polymer in the polymer solution has a concentration of about 100 mg/mL to 200 mg/mL.

In one embodiment, the metal precursor solution includes a metal compound and chemically reducing agent. The metal compound can be a silver compound (e.g. silver nitrate or silver oxide), platinum compound (e.g. platinum chloride or platinous oxide), gold compound (e.g. gold chloride or auric acid), or combinations thereof. The selection of the chemically reducing agent depends on the metal compound type. For example, when the metal compound is silver nitrate, the chemically reducing agent can be ethylene glycol. When the metal compound is silver oxide, the chemically reducing agent can be ammonium hydroxide. When the metal compound is platinum chloride, the chemically reducing agent can be hydrazine, sodium hydroborate, hydrogen, or alcohol. When the metal compound is gold chloride, the chemically reducing agent can be an aqueous solution of sodium citrate or Vitamin C. The metal compound concentration depends on the metal compound type. For example, the silver nitrate has a concentration of about 1 mg/mL to 100 mg/mL, and the silver oxide has a concentration of about 1 mg/mL to 100 mg/mL. The chemically reducing agent concentration depends on the chemically reducing agent type. For example, the ethylene glycol may directly serve as an organic solvent with high-polarity, and the ammonium hydroxide may have a concentration of about 1 wt % to 50 wt %.

In one embodiment, the core pipe 15I of the needle 15 has a diameter of about 0.5 m to 2 mm, which is determined by the desired diameter of the nano metal wire. In one embodiment, the shell pipe 15O and the core pipe 15I of the needle 15 have a difference of about 0.01 mm to 5 mm.

In one embodiment, the voltage applied to the needle 15 is about 10 kV to 12 kV. In one embodiment, a tip of the needle 15 and the collector 19 have a distance therebetween of about 5 cm to 50 cm. If the collector 19 is a common plate, random arranged nano lines 17 will be easily formed. If the collector 19 is parallel electrode plate, parallel arranged nano lines 17 will be formed.

In one embodiment, the syringes 11 and 13 are controlled by syringe pumps 12 and 14, respectively, to tune flow rates of the polymer solution and the metal precursor solution. For example, the polymer solution is jetted out of the needle 15 with a flow rate of about 0.1 mL/hr to 5 mL/hr, and the metal precursor solution is jetted out of the needle 15 with a flow rate of about 0.01 mL/hr to 1 mL/hr.

Figure 4:
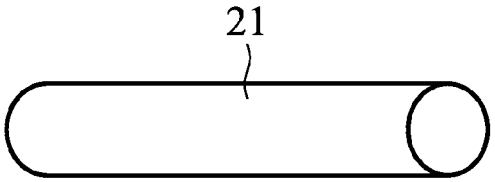
FIG. 4 shows a nano metal wire in one embodiment of the disclosure.

After the described steps, the nano lines 17 can be left at room temperature under the regular atmosphere, such that the metal compound is slowly chemically reduced by the chemically reducing agent in the metal precursor wires 17A. As a result, nano metal wires 21 are obtained. In one embodiment, the nano lines 17 can be annealed under the atmosphere to accelerate chemical reduction. For example, the anneal step can be performed at a temperature of about 100° C. to 200° C. A suitable solvent can be adopted to wash out the polymer tube 17B surrounding around the nano metal wire 21. For example, when the polymer tube 17B is PVP, it can be washed out by water, and the nano metal wires 21 in FIG. 4 are left. When the polymer tube 17B is PAN, it can be washed out by THF. The nano metal wire 21 prepared by the described steps has a diameter of 50 nm to 500 nm, an aspect ratio of greater than 1000, and a conductivity of about $10^4$S/m to $10^7$S/m. Note that the nano metal wire 21 has an unlimited maximum length. In other words, the nano metal wire has an unlimited maximum aspect ratio. In one embodiment, the nano metal wire 21 may have a centimeter-scaled length, e.g. at least 1 cm or even at least 10 cm. The nano metal wire 21 can be applied to an anti-EMI paint, an RFID device, a solar cell conductive paste, a long-lasting and anti-bacterial peelable spray, and a transparent conductive film, and the likes.

Below, exemplary embodiments will be described in detail with reference to the accompanying drawings so as to be easily realized by a person having ordinary knowledge in the art. The inventive concept may be embodied in various forms without being limited to the exemplary embodiments set forth herein. Descriptions of well-known parts are omitted for clarity, and like reference numerals refer to like elements throughout.

EXAMPLES

In following examples, the needle had a shell pipe with a diameter of 1.25 mm and a core pipe with a diameter of 0.95 mm. The needle and the parallel electrode collector plate had a distance of 13 cm therebetween. The voltage applied to the needle was 10 kV. One electrode plate of the parallel electrode collector plate was electrically connected to ground, and another electrode plate was electrically connected to a voltage of 1 kV. Diameters of the nano lines and the nano metal wires were all measured by transmission electron microscopy (TEM, JEOL JEM-2100F).

Example 1

An ethylene glycol solution of silver nitrate (30 mg/mL) was put into a syringe connected to a core pipe of a needle. A methanol solution of PVP (200 mg/mL) was put into another syringe connected to a shell pipe of the needle. The silver precursor solution in the core pipe was controlled by a syringe pump to have a flow rate of 0.1 mL/hr, and the polymer solution in the shell pipe was controlled by another syringe pump to have a flow rate of 1 mL/hr. A nano line having a diameter of about 2.2 μm was electrostatically spun.

Figure 5:
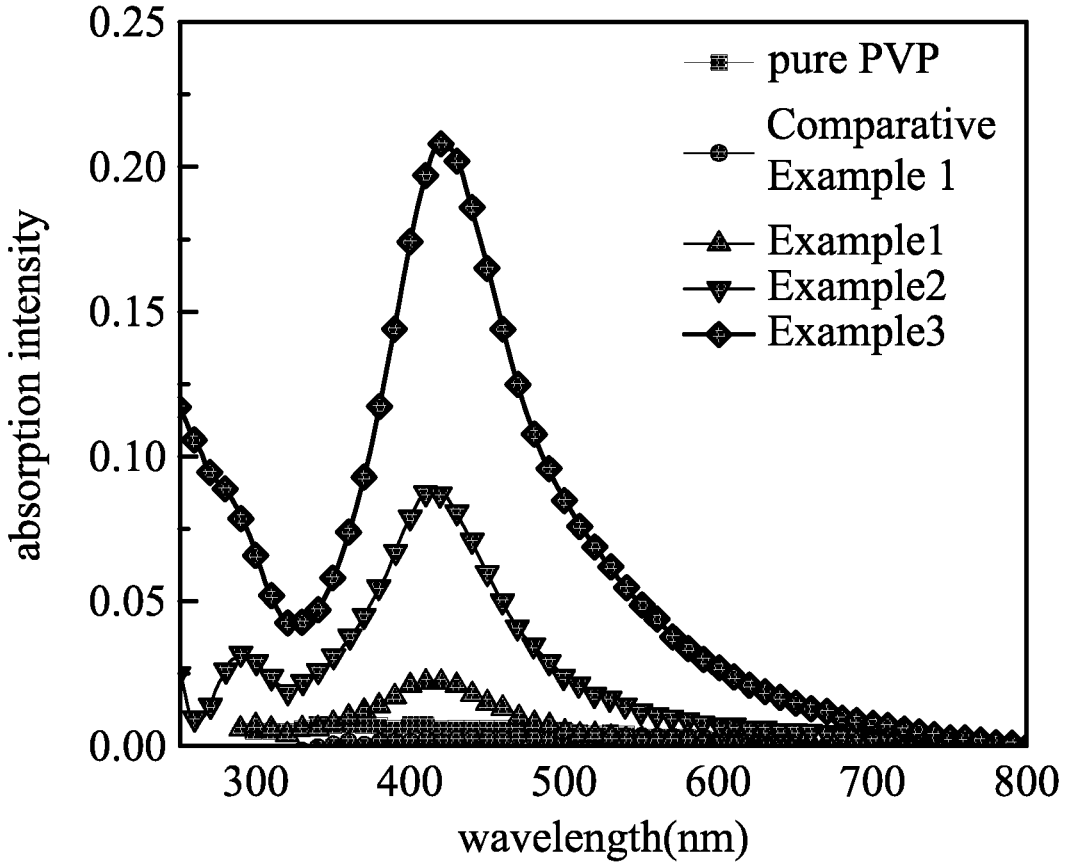
FIG. 5 shows absorption spectra of nano silver wires without annealing or after annealing for different periods of time in some embodiments of the disclosure.

The nano line was annealed at 150° C. under the atmosphere for about 8 minutes, and then washed by water to remove the polymer tube. As such, a nano silver wire with a diameter of about 500 nm, a length of about 10 cm, and an aspect ratio of 200000 was obtained. The nano silver wire was measured by a spectrometer to obtain its absorption spectrum as shown in FIG. 5.

Example 2

Similar to Example 1, the difference in Example 2 was the annealing period being changed to about 20 minutes. After annealing, the nano line was washed by water to remove the polymer tube. As such, a nano silver wire with a diameter of about 500 nm, a length of about 10 cm, and an aspect ratio of 200000 was obtained. The nano silver wire was measured by a spectrometer to obtain its absorption spectrum as shown in FIG. 5.

Example 3

Similar to Example 1, the difference in Example 3 was the annealing period being changed to about 10 hours. After annealing, the nano line was washed by water to remove the polymer tube. As such, a nano silver wire with a diameter of about 500 nm, a length of about 10 cm, and an aspect ratio of 200000 was obtained. The nano silver wire was measured by a spectrometer to obtain its absorption spectrum as shown in FIG. 5.

Comparative Example 1

Similar to Example 1, the difference in Comparative Example 1 was the nano line having a diameter of 2.2 μm being directly washed by water to remove the polymer tube (without any annealing). The silver precursor wire was measured by a spectrometer to obtain its absorption spectrum as shown in FIG. 5.

TABLE 1

| | Annealing period at 150° C. | Nano silver wire diameter | Nano silver wire length | Nano silver wire aspect ratio |
|---|---|---|---|---|
| Example 1 | 8 minutes | ~500 nm | 10 cm | $2 \times 10^5$ |
| Example 2 | 20 minutes | ~500 nm | 10 cm | $2 \times 10^5$ |
| Example 3 | 10 hours | ~500 nm | 10 cm | $2 \times 10^5$ |
| Comparative Example 1 | Without annealing | none | none | none |

As shown in FIG. 5 and Table 1, the absorption peaks at about 420 nm of the nano silver wires were higher and red-shifted as the length of the annealing periods were increased. Accordingly, the annealing step was beneficial for chemically reducing the silver nitrate to silver.

Example 4

Figure 6:
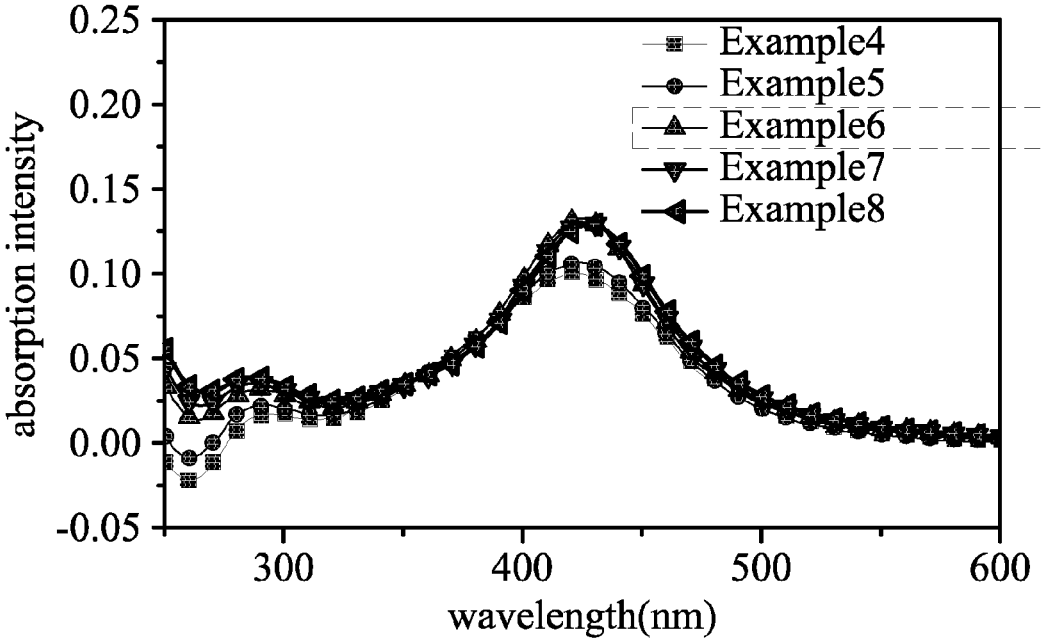
FIG. 6 shows absorption spectra of nano silver wires left to stand at room temperature for different periods of time or annealing for different periods of time in some embodiments of the disclosure.

An ammonium hydroxide solution of silver oxide (with a silver oxide concentration of 5 mg/mL and an ammonium hydroxide concentration of 33%) was put into a syringe connected to a core pipe of a needle. A methanol solution of PVP (200 mg/mL) was put into another syringe connected to a shell pipe of the needle. The silver precursor solution in the core pipe was controlled by a syringe pump to have a flow rate of 0.01 mL/hr, and the polymer solution in the shell pipe was controlled by another syringe pump to have a flow rate of 1 mL/hr. A nano line having a diameter of about 1 μm was electrostatically spun. The nano line was left to stand at room temperature under the atmosphere for 4 hours, and then washed by water to remove the polymer tube. As such, a nano silver wire with a diameter of about 300 nm and a length of 10 cm was obtained. The nano silver wire was measured by a spectrometer to obtain its absorption spectrum as shown in FIG. 6.

Example 5

Similar to Example 4, the difference in Example 5 was the nano line being left to stand at room temperature under the atmosphere for 4 days. Thereafter, the nano line was washed by water to remove the polymer tube. As such, the nano silver wire with a diameter of about 300 nm and a length of 10 cm was obtained. The nano silver wire was measured by a spectrometer to obtain its absorption spectrum as shown in FIG. 6.

Example 6

Similar to Example 4, the difference in Example 6 was the nano line having a diameter of about 1 μm being annealed at 200° C. under the atmosphere for 10 minutes. Thereafter, the nano line was washed by water to remove the polymer tube. As such, the nano silver wire with a diameter of about 300 nm and a length of 10 cm was obtained. The nano silver wire was measured by a spectrometer to obtain its absorption spectrum as shown in FIG. 6.

Example 7

Similar to Example 6, the difference in Example 7 was the nano line being annealed at 200° C. for 20 minutes. Thereafter, the nano line was washed by water to remove the polymer tube. As such, the nano silver wire with a diameter of about 300 nm and a length of 10 cm was obtained. The nano silver wire was measured by a spectrometer to obtain its absorption spectrum as shown in FIG. 6.

Example 8

Similar to Example 6, the difference in Example 8 was the nano line being annealed at 200° C. for 30 minutes. Thereafter, the nano line was washed by water to remove the polymer tube. As such, the nano silver wire with a diameter of about 300 nm and a length of 10 cm was obtained. The nano silver wire was measured by a spectrometer to obtain its absorption spectrum as shown in FIG. 6.

TABLE 2

| | Anneal temperature/period | Nano silver wire diameter | Nano silver wire length | Nano silver wire aspect ratio |
|---|---|---|---|---|
| Example 4 | Room temperature/ 4 hours | ~300 nm | 10 cm | $3.3 \times 10^5$ |
| Example 5 | Room temperature/ 4 days | ~300 nm | 10 cm | $3.3 \times 10^5$ |
| Example 6 | 200° C./10 minutes | ~300 nm | 10 cm | $3.3 \times 10^5$ |
| Example 7 | 200° C./20 minutes | ~300 nm | 10 cm | $3.3 \times 10^5$ |
| Example 8 | 200° C./30 minutes | ~300 nm | 10 cm | $3.3 \times 10^5$ |

As shown in FIG. 6 and Table 2, the nano silver wires were formed by only being left to stand at room temperature for a long period without annealing. However, the anneal step may accelerate the forming of the nano silver wires. The nano silver wire having a diameter of 300 nm and a length of 10 cm was formed by annealing at a temperature of 200° C. for a period of 10 minutes (longer annealing period was not needed). The nano silver wire had a conductivity of $6.9 \times 10^4$ S/m.

Example 9

An ammonium hydroxide solution of silver oxide (with a silver oxide concentration of 1 mg/mL and an ammonium hydroxide concentration of 33%) was put into a syringe connected to a core pipe of a needle. A methanol solution of PVP and TBAP (with a PVP concentration of 100 mg/mL and a TBAP concentration of 10 mg/mL) was put into another syringe connected to a shell pipe of the needle. The silver precursor solution in the core pipe was controlled by a syringe pump to have a flow rate of 0.01 mL/hr, and the polymer solution in the shell pipe was controlled by another syringe pump to have a flow rate of 1 mL/hr. A nano line having a diameter of about 0.6 μm and a length of 10 cm was electrostatically spun. The nano line was annealed at 200° C. under the atmosphere for 20 minutes, and then washed by water to remove the polymer tube. As such, a nano silver wire with a diameter of about 357 nm was obtained.

Example 10

An ammonium hydroxide solution of silver oxide (with a silver oxide concentration of 5 mg/mL and an ammonium hydroxide concentration of 33%) was put into a syringe connected to a core pipe of a needle. A methanol solution of PVP and TBAP (with a PVP concentration of 100 mg/mL and a TBAP concentration of 10 mg/mL) was put into another syringe connected to a shell pipe of the needle. The silver precursor solution in the core pipe was controlled by a syringe pump to have a flow rate of 0.01 mL/hr, and the polymer solution in the shell pipe was controlled by another syringe pump to have a flow rate of 1 mL/hr. A nano line having a diameter of about 0.7 μm and a length of 10 cm was electrostatically spun. The nano line was annealed at 200° C. under the atmosphere for 20 minutes, and then washed by water to remove the polymer tube. As such, a nano silver wire with a diameter of about 464 nm was obtained. As known by comparison with Example 9, a nano silver wire having a larger diameter can be obtained through a higher silver oxide concentration.

Example 11

An ammonium hydroxide solution of silver oxide (with a silver oxide concentration of 1 mg/mL and an ammonium hydroxide concentration of 33%) was put into a syringe connected to a core pipe of a needle. A methanol solution of PVP and TBAP (with a PVP concentration of 100 mg/mL and a TBAP concentration of 30 mg/mL) was put into another syringe connected to a shell pipe of the needle. The silver precursor solution in the core pipe was controlled by a syringe pump to have a flow rate of 0.01 mL/hr, and the polymer solution in the shell pipe was controlled by another syringe pump to have a flow rate of 1 mL/hr. A nano line having a diameter of about 0.4 μm and a length of 10 cm was electrostatically spun. The nano line was annealed at 200° C. under the atmosphere for 20 minutes, and then washed by water to remove the polymer tube. As such, a nano silver wire with a diameter of about 285 nm was obtained. As known by comparison with Example 9, a nano silver wire having a smaller diameter can be obtained through a higher TBAP concentration.

Figure 7:
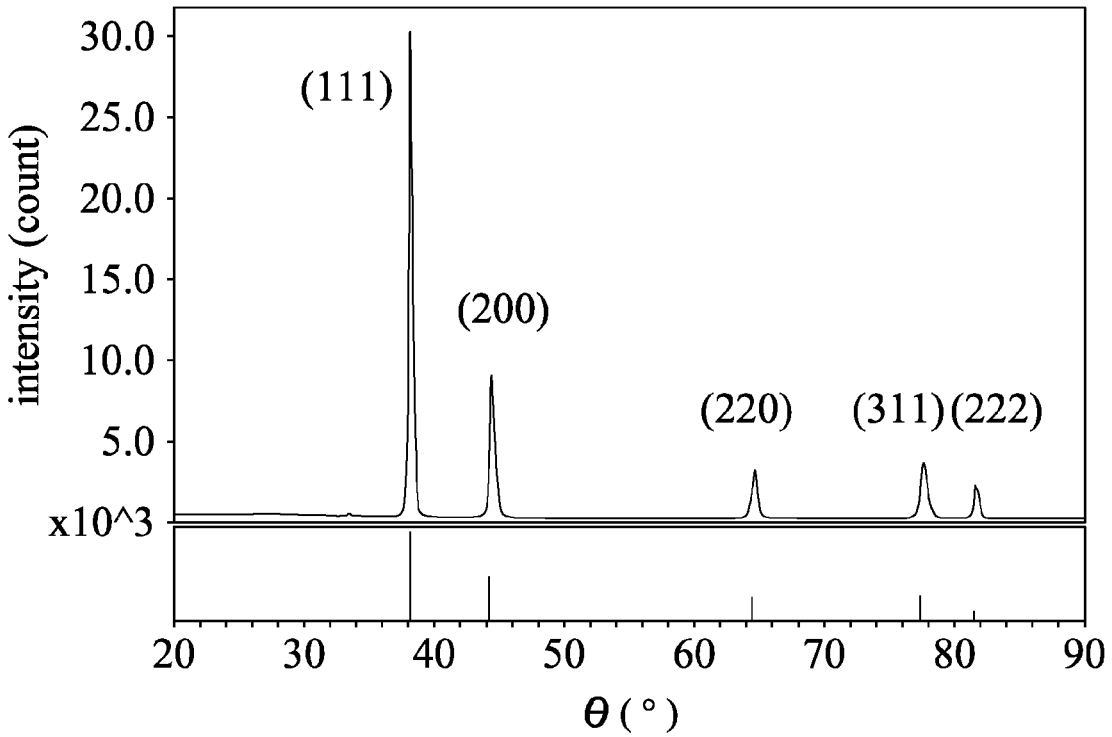
FIG. 7 shows an XRD spectrum of nano silver wires in one embodiment of the disclosure.

The nano silver wire in Example 11 had a resistivity of $4.3\times10^{-4}\Omega\cdot$cm. A bulk silver had a resistivity of $1.6\times10^{-6}\Omega\cdot$cm (See Applied Physics Letters 95, 103112, 2009). A single crystalline nano silver wire had a resistivity of $2.19\times10^{-4}\Omega\cdot$cm (See Applied Physics Letters 95, 103112, 2009). A poly crystalline nano silver wire had a resistivity of $8.29\times10^{-4}\Omega\cdot$cm (See Nano letter, Vol. 2, No. 2, 2002). Accordingly, the nano silver wire prepared in Example 11 of the disclosure should be a single crystalline nano silver wire. An XRD spectrum of the nano silver wire is shown in FIG. 7. The nano silver wire had a single crystalline face-centered cubic structure, as determined by TEM and XRD. Also, the nano silver wire had high uniformity and a high conductivity.

Example 12

An ammonium hydroxide solution of silver oxide (with a silver oxide concentration of 5 mg/mL and an ammonium hydroxide concentration of 33%) was put into a syringe connected to a core pipe of a needle. A methanol solution of PVP and TBAP (with a PVP concentration of 100 mg/mL and a TBAP concentration of 30 mg/mL) was put into another syringe connected to a shell pipe of the needle. The silver precursor solution in the core pipe was controlled by a syringe pump to have a flow rate of 0.01 mL/hr, and the polymer solution in the shell pipe was controlled by another syringe pump to have a flow rate of 1 mL/hr. A nano line having a diameter of about 0.6 μm and a length of 10 cm was electrostatically spun. The nano line was annealed at 200° C. under the atmosphere for 20 minutes, and then washed by water to remove the polymer tube. As such, a nano silver wire with a diameter of about 375 nm was obtained. As known by comparison with Example 11, a nano silver wire having a larger diameter can be obtained through a higher silver oxide concentration. As known by comparison with Example 10, a nano silver wire having a smaller diameter can be obtained through a higher TBAP concentration.

TABLE 3

| | Silver oxide concentration | TBAP concentration | Nano silver wire diameter | Nano silver wire length | Nano silver wire aspect ratio |
|---|---|---|---|---|---|
| Example 9 | 1 mg/mL | 10 mg/mL | ~357 nm | 10 cm | $2.8\times10^5$ |
| Example 10 | 5 mg/mL | 10 mg/mL | ~464 nm | 10 cm | $2.2\times10^5$ |
| Example 11 | 1 mg/mL | 30 mg/mL | ~285 nm | 10 cm | $3.5\times10^5$ |
| Example 12 | 5 mg/mL | 30 mg/mL | ~375 nm | 10 cm | $2.7\times10^5$ |

It will be apparent to those skilled in the art that various modifications and variations can be made to the disclosed methods and materials. It is intended that the specification and examples be considered as exemplary only, with a true scope of the disclosure being indicated by the following claims and their equivalents.

What is claimed is:

1. A method of manufacturing a nano metal wire, comprising:

putting a metal precursor solution consisting of a metal compound and a chemical reducing agent in a core pipe of a needle;

putting a polymer solution in a shell pipe of the needle, wherein the shell pipe surrounds the core pipe;

applying a voltage to the needle while simultaneously jetting the metal precursor solution and the polymer solution to form a nano line on a collector, wherein the nano line includes a metal precursor wire surrounded by a polymer tube;

chemically reducing the metal precursor wire of the nano line to form a nano line of a nano metal wire surrounded by the polymer tube; and washing out the polymer tube by a solvent.

2. The method as claimed in claim 1, wherein the polymer solution further comprises a salt.

3. The method as claimed in claim 2, wherein the salt has a concentration of 1 mg/mL to 100 mg/mL.

4. The method as claimed in claim 1, wherein the metal wire of the nano line comprises silver, platinum, gold, or combinations thereof.

5. The method as claimed in claim 1, wherein the polymer tube comprises polyvinylpyrrolidone (PVP).

6. The method as claimed in claim 1, wherein the polymer solution is jetted out of the needle with a flow rate of 0.1 mL/hr to 5 mL/hr.

7. The method as claimed in claim 1, wherein the metal precursor solution is jetted out of the needle with a flow rate of 0.01 mL/hr to 1 mL/hr.

8. The method as claimed in claim 1, wherein the shell pipe and the core pipe are concentric cylinders.

9. The method as claimed in claim 1, wherein the core pipe has a diameter of 0.5 mm to 2 mm.

10. The method as claimed in claim 1, wherein the shell pipe and the core pipe have a diameter difference of 0.01 mm to 5 mm.

11. The method as claimed in claim 1, wherein the step of chemically reducing the metal precursor wire of the nano line comprises an annealing step performed at a temperature of 100° C. to 200° C.

12. The method as claimed in claim 1, wherein the voltage is between 10 kV to 12 kV.

13. The method as claimed in claim 1, wherein a tip of the needle and the collector has a distance of 5 cm to 50 cm therebetween.

14. The method as claimed in claim 1, wherein the nano metal wire has a length of greater than or equal to 1 cm.

* * * * *